US008029163B2

(12) United States Patent
Chen et al.

(10) Patent No.: US 8,029,163 B2
(45) Date of Patent: Oct. 4, 2011

(54) LED UNIT

(75) Inventors: Chin-Chung Chen, Taipei Hsien (TW); Hai-Wei Zhang, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 336 days.

(21) Appl. No.: 12/409,505

(22) Filed: Mar. 24, 2009

(65) Prior Publication Data

US 2010/0165636 A1 Jul. 1, 2010

(30) Foreign Application Priority Data

Dec. 26, 2008 (CN) ..... 2008 1 0306568

(51) Int. Cl.
*F21V 5/04* (2006.01)
*F21V 7/00* (2006.01)

(52) U.S. Cl. ..... 362/308; 362/327; 362/310; 362/329; 362/311.02

(58) Field of Classification Search ..... 362/308, 362/327, 307, 309, 310, 311.02, 329, 335, 362/347, 334, 340, 800; 257/98
See application file for complete search history.

(56) References Cited

U.S. PATENT DOCUMENTS 2,254,961 A * 9/1941 Harris ..... 362/327
6,724,543 B1 * 4/2004 Chinniah et al. ..... 359/718
7,111,964 B2 * 9/2006 Suehiro et al. ..... 362/328
7,461,960 B2 * 12/2008 Opolka et al. ..... 362/545
7,473,013 B2 * 1/2009 Shimada ..... 362/327
7,618,160 B2 * 11/2009 Chinniah et al. ..... 362/326
2001/0007527 A1 * 7/2001 Lammers et al. ..... 362/294
2007/0263390 A1 * 11/2007 Timinger et al. ..... 362/308
2010/0014286 A1 * 1/2010 Yoneda et al. ..... 362/231

FOREIGN PATENT DOCUMENTS

CN 1692503 A 11/2005
CN 1901238 A 1/2007
WO 2006109113 A2 10/2006

* cited by examiner

*Primary Examiner* — Bao Q Truong
(74) *Attorney, Agent, or Firm* — Altis Law Group, Inc.

(57) ABSTRACT

An LED unit includes an LED and an envelope receiving the LED therein. The envelope includes a bottom substrate fixing the LED thereon, a sidewall angling upwardly from the substrate and surrounding the LED, and a lens formed in the sidewall and located above the LED. The lens has two aspheric surfaces with different curvatures to collect light deflected at a small angle relative to an axis of the LED into a parallel pattern. The sidewall has upper and lower conical inner circumferences and a parabolic outer circumference to direct light deflected at a large angle relative to the axis of the LED into parallel pattern. The lower inner circumference of the sidewall has an angle of $2\pi/5$ to $13\pi/30$, and the upper inner circumference of the sidewall has an angle of $5\pi/36$ to $7\pi/36$.

16 Claims, 3 Drawing Sheets

LED UNIT

BACKGROUND OF THE INVENTION

1. Field of the Invention

The present disclosure relates to light emitting diode (LED) units and, more particularly, to an LED unit comprising a lens having two aspheric surfaces.

2. Description of Related Art

LEDs, available since the early 1960's, have been increasingly used in a variety of applications, such as residential, traffic, commercial, and industrial settings, because of high light-emitting efficiency. A typical LED includes an LED die emitting light and a transparent encapsulant enveloping the LED die. The encapsulant protects the LED die from contamination and damage, and acts as a lens. However, due to size limitations of the encapsulant, the light cannot be significantly converged. The divergent light results in limited brightness of the LED. Therefore, light-adjusting devices, such as a catadioptric light distribution system, are utilized for further collimation of the light from the LED.

A typical catadioptric light distribution system includes a reflector mounted below and surrounding the LED, and a convex lens mounted above the LED. The reflector reflects light toward the lens from a perimeter of the encapsulant. The lens consolidates light emitted from the LED and reflected by the reflector into a single beam. Using the catadioptric light distribution system, most of the light emitted from the LED can be converged, and the brightness of the LED is increased.

However, since the lens of the catadioptric light distribution system is often spherical, the lens cannot effectively culminate the light into a narrow beam. The light incident on an opposite surface of the lens, after passing through the spherical surface of the lens, is still divergent, resulting in a scattered light beam, oriented away from the lens, and thus unsuitable for long-distance illumination.

What is needed, therefore, is an LED unit which can overcome the limitations described.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EMBODIMENTS

Figure 1:
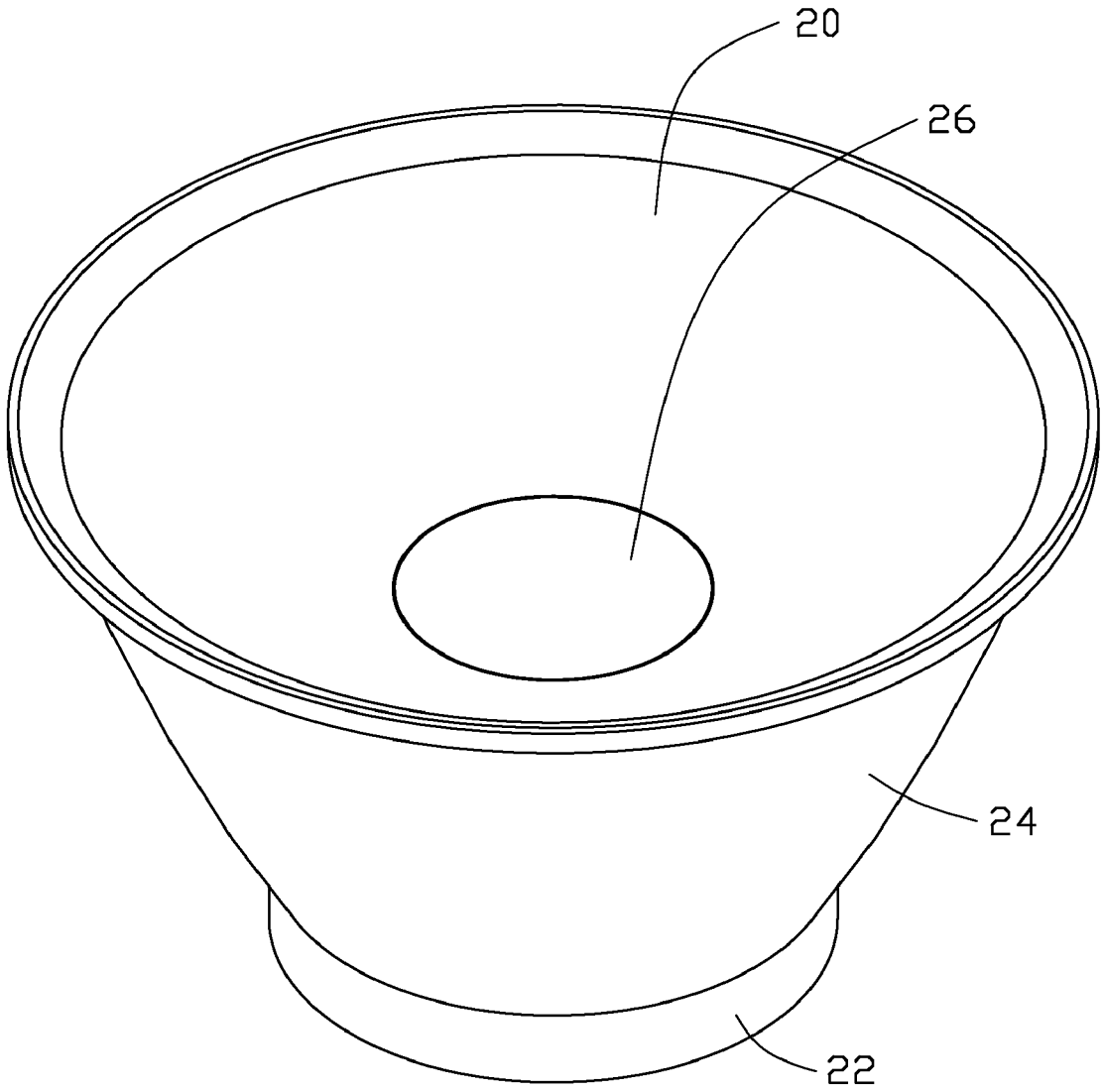
FIG. 1 is an assembled view of an embodiment of an LED unit.
Figure 3:
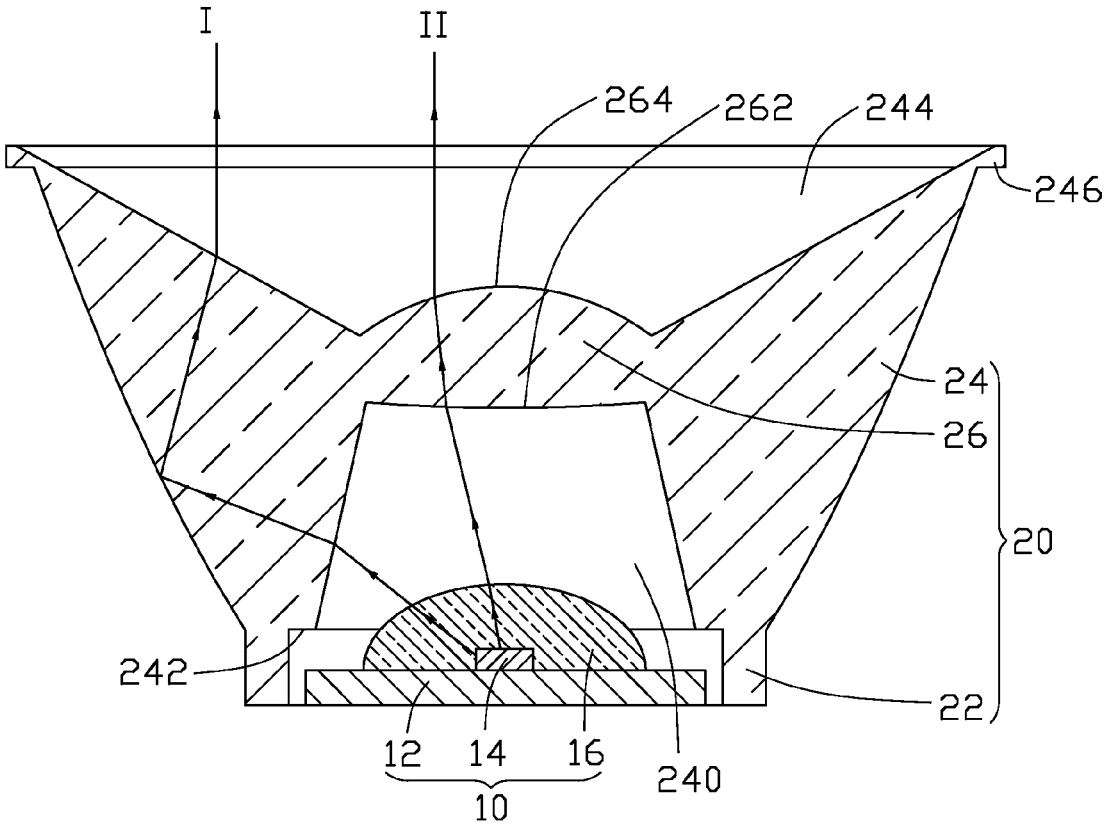
FIG. 3 is a cross-section of the LED unit of FIG. 1.

Referring to FIGS. 1 and 3, an embodiment of an LED unit includes an LED 10 (see FIG. 3) and a catadioptric light distribution system 20 seating the LED 10. The catadioptric light distribution system 20 has an optical axis parallel with that of the LED 10. The LED 10 may be any LED, but an LED capable of emitting white light with high brightness is preferred The LED 10 includes a rectangular base 12 with an LED die 14 fixed on a top thereof and an encapsulant 16 enveloping the LED die 14 and fixed on the top of the base 12. The encapsulant 16 may be dome-shaped, thereby acting as a primary convex lens to collimate the light emitted from the LED die 14 into a drop-like pattern.

Figure 2:
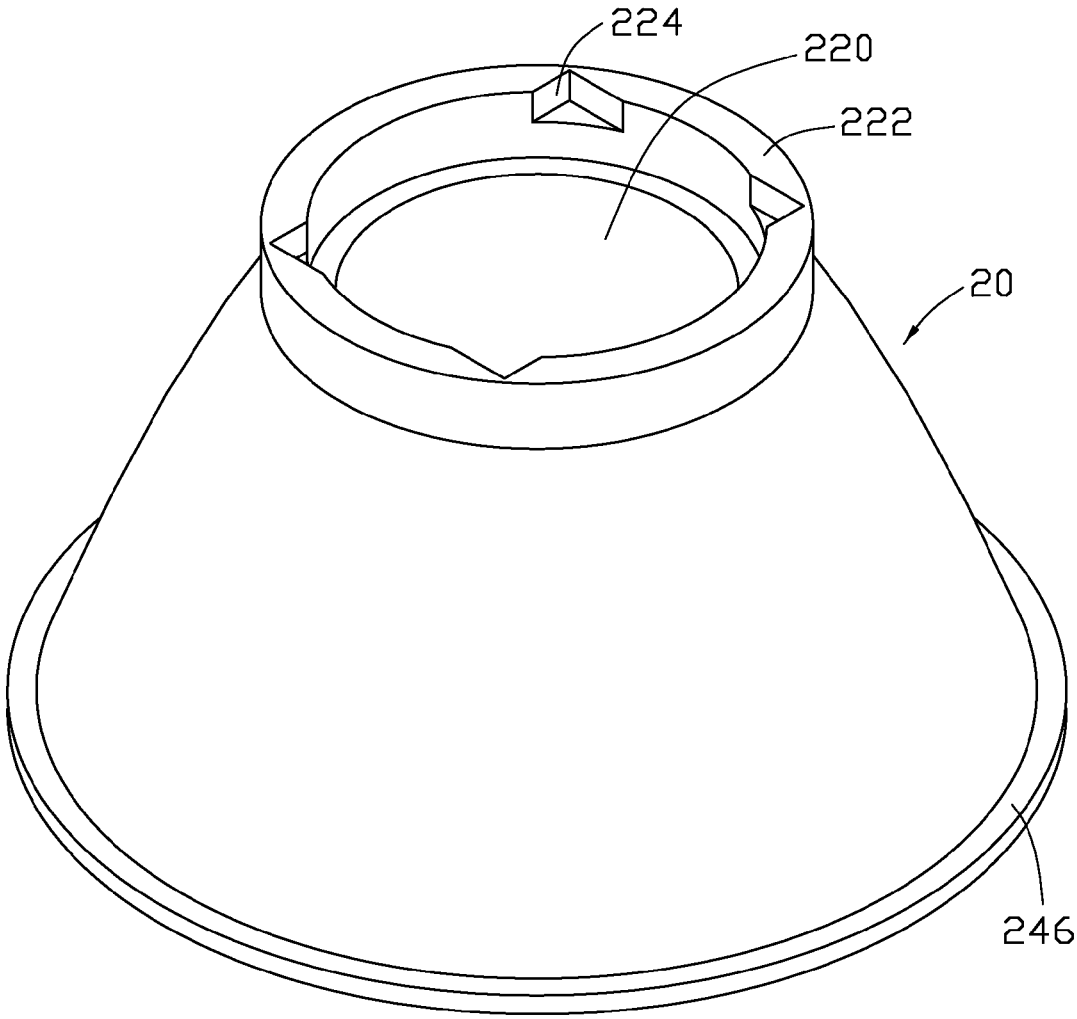
FIG. 2 is an inverted view of FIG. 1 with an LED removed from the LED unit for clarity.

Also referring to FIG. 2, the catadioptric light distribution system 20 may be integrally made of a light-permeable material, such as PC or PMMA. The catadioptric light distribution system 20 includes a substrate 22, a sidewall 24 angling upwardly from a periphery of the substrate 22 and a lens 26 formed within the sidewall 24. An outer circumferential surface of the sidewall 24 is coated with a light reflective material. The substrate 22 is circular with a central hole 220 defined through the substrate 22 and surrounded by an annulus 222. Four triangular cutouts 224 may be defined in the annulus 222, around and communicating with the central hole 220, cooperatively defining a rectangular space (not labeled). The four cutouts 224 each have a depth less than a thickness of the substrate 22 for receiving the base 12 of the LED 10 in the rectangular space. An inner circumferential surface of a lower portion of the sidewall 24 is conical having an opening facing downwardly and gradually expanding downwardly. The lower portion of the sidewall 24 cooperates with a bottom surface of the lens 26 to enclose a cavity 240 within the catadioptric light distribution system 20. A bottom of the cavity 240 communicates with the central hole 220 of the substrate 22, thereby receiving the encapsulant 16 of the LED 10 therein. The cavity 240 separates the encapsulant 16 of the LED 10 from the sidewall 24 and the lens 26 with an air gap so that the light emitted from the LED die 14 is refracted twice when incident onto the sidewall 24 and the lens 26, wherein the light biased at a large angle with respect to an axis of the LED 10 (such as light I referenced in FIG. 3) is incident on the inner circumferential surface of the sidewall 24, and the light deflected at a small angle with respect to the axis of the LED (such as light II referenced in FIG. 3) is incident on the bottom surface of the lens 26. An inner diameter of the cavity 240 at a bottom thereof may be less than that of the central hole 220 of the substrate 22, thereby forming a step 242 between the cavity 240 and the central hole 220. The outer circumferential surface of the sidewall 24 is parabolic, totally reflecting the light from the inner circumferential surface of the sidewall 24 toward a top of the catadioptric light distribution system 20. The top of the catadioptric light distribution system 20 defines a recess 244 surrounded by an inner circumferential surface of an upper portion of the sidewall 24 and above a top surface of the lens 26. The inner circumferential surface of the upper portion of the sidewall 24 is a conical surface having an opening gradually expanding upwardly, whereby the light totally reflected by the outer circumferential surface of the sidewall 24 is refracted by the inner circumferential surface of the upper portion of the sidewall 24 into parallel light pattern. An angle of the inner circumferential surface of the upper portion of the sidewall 24 is less than that of the inner circumferential surface of the lower portion of the sidewall 24. An angle of the inner circumferential surface of the upper portion of the sidewall 24 may range between $5\pi/36$ to $7\pi/36$. An angle of the inner circumferential surface of the lower portion of the sidewall 24 may range between $2\pi/5$ to $13\pi/30$. An annular flange 246 may be protruded horizontally and outwardly from a top of the sidewall 24, facilitating a handle of the catadioptric light distribution system 20.

The lens 26 may be located just above the LED 10 to culminate the light from the LED 10 into a straight beam. The bottom surface and the top surface of the lens 26 may be particularly configured to a first aspheric surface 262 and a second aspheric surface 264, respectively. The second aspheric surface 264 has a curvature larger than that of the first aspheric surface 262, both of which consolidate light having a small emergent angle from the encapsulant 16 of the LED 10 into a parallel light pattern. Due to favorable light-converging characteristics of the aspheric surfaces 262, 264, the light near the optical axis is collected by the lens 26 more concentrically to a narrow beam of relatively high intensity, able to travel a long distance without significant dissipation. In addition, due to the divisional cooperation of the lens 26 and the sidewall 24, with the sidewall 24 converting the light from the LED 10 with a large emergent angle into parallel light by two refractions and one total reflection, and the lens 26 converting the light from the LED 10 with the small emergent angle into parallel light by two refractions, the light travelling within the catadioptric light distribution system 20 does not interfere with each other; thus, consistency of the light output from the catadioptric light distribution system 20 is ensured. Using the catadioptric light distribution system 20, the light output from the LED unit is 50% concentrated within a conical angle deflected at 5° with respect to the axis of the LED unit, whereby a light-extracting efficiency of the LED unit is raised to nearly 90%.

It is believed that the present disclosure and its advantages will be understood from the foregoing description, and it will be apparent that various changes may be made thereto without departing from the spirit and scope of the present disclosure or sacrificing all of its material advantages, the examples hereinbefore described merely being preferred or exemplary embodiments.

What is claimed is:

1. An LED unit, comprising:

an LED; and a light-permeable envelope enclosing the LED therein; the envelope comprising:

a sidewall surrounding the LED;

a light reflective material coated at an outer circumferential surface of the sidewall;

a lens connected to the sidewall and located above the LED; and a substrate connected to a bottom of the sidewall;

wherein a top surface of the lens is aspherical; and wherein the substrate has a plurality of cutouts in a bottom thereof, the plurality of cutouts each having a depth less than a thickness of the substrate and cooperatively forming a space receiving a lower portion of the LED.

2. The LED unit as claimed in claim 1, wherein a bottom surface of the lens is further aspherical, presenting a curvature less that than of the top aspherical surface.

3. The LED unit as claimed in claim 1, wherein the envelope is integrally formed of a transparent material.

4. The LED unit as claimed in claim 1, wherein an inner circumferential surface of a lower portion of the sidewall and the bottom surface of the lens cooperatively form a cavity in which an upper portion of the LED is received and separated from the sidewall and the lens by an air gap.

5. The LED unit as claimed in claim 4, wherein the inner circumferential surface of the lower portion of the sidewall is conical, comprising an opening expanded downwardly.

6. The LED unit as claimed in claim 5, wherein an inner circumferential surface of an upper portion of the sidewall is conical, having an opening expanding upwardly, an angle of the inner circumferential surface of the upper portion of the sidewall being less than that of the inner circumferential surface of the lower portion of the sidewall.

7. The LED unit as claimed in claim 6, wherein the angle of the inner circumferential surface of the upper portion of the sidewall is $5\pi/36$ to $7\pi/36$, and the angle of the inner circumferential surface of the lower portion of the sidewall is $2\pi/5$ to $13\pi/30$.

8. The LED unit as claimed in claim 4, wherein the outer circumferential surface of the sidewall is parabolic.

9. The LED unit as claimed in claim 4, wherein the substrate defines a through hole communicating with the cavity.

10. The LED unit as claimed in claim 9, wherein the through hole has an inner diameter exceeding that of the cavity at the bottom of the sidewall, a step being formed between the through hole and the cavity.

11. An LED unit comprising:

an LED; and a transparent or semitransparent housing receiving the LED and collimating light therefrom into a parallel pattern;

wherein the light from the LED with a large emergent angle is collimated by the housing by two refractions and one total reflection, and light from the LED with a small emergent angle is collimated by the housing by two refractions;

wherein the housing comprises two aspheric surfaces in the pathway of the light from the LED with the small emergent angle; and wherein the housing comprises a sidewall surrounding the LED and a substrate connected to a bottom of the sidewall, the substrate having a plurality of cutouts in a bottom thereof, the plurality of cutouts each having a depth less than a thickness of the substrate and cooperatively forming a space receiving a lower portion of the LED.

12. The LED unit as claimed in claim 11, wherein the housing is made integrally of epoxy or silicon.

13. The LED unit as claimed in claim 11, wherein the housing sequentially comprises a first conical surface, a parabolic surface, and a second conical surface in the pathway of the light from the LED with the large emergent angle.

14. The LED unit as claimed in claim 13, wherein the first conical surface has an angle ranging from $2\pi/5$ to $13\pi/30$, and the second conical surface has an angle ranging from $5\pi/36$ to $7\pi/36$.

15. The LED unit as claimed in claim 11, wherein one of the two aspheric surfaces adjacent to the LED has a curvature less than that of one of the two aspheric surfaces remote from the LED.

16. The LED unit as claimed in claim 11, wherein an upper portion of the LED is separated by an air gap from the housing, and a lower portion of the LED is engagingly retained in the housing.

* * * * *